US006991044B2

(12) United States Patent
Zhang et al.

(10) Patent No.: US 6,991,044 B2
(45) Date of Patent: Jan. 31, 2006

(54) HIGH-ENERGY COMBINED WELL PERFORATING DEVICE

(75) Inventors: Xi Zhang, Shaanxi (CN); Tinghan Zhang, Shaanxi (CN)

(73) Assignee: Xi'An Tongyuan Petrotech Co., Ltd., Shaanxi (CN)

( * ) Notice: Subject to any disclaimer, the term of this patent is extended or adjusted under 35 U.S.C. 154(b) by 24 days.

(21) Appl. No.: 10/467,231

(22) PCT Filed: Feb. 6, 2002

(86) PCT No.: PCT/CN02/00068

§ 371 (c)(1),
(2), (4) Date: Dec. 17, 2003

(87) PCT Pub. No.: WO02/063133

PCT Pub. Date: Aug. 15, 2002

(65) Prior Publication Data

US 2004/0129415 A1 Jul. 8, 2004

(30) Foreign Application Priority Data

Feb. 6, 2001 (CN) ..... 01212979 U
Feb. 6, 2001 (CN) ..... 01212980 U
Feb. 6, 2001 (CN) ..... 01212981 U

(51) Int. Cl.
*E21B 43/117* (2006.01)

(52) U.S. Cl. ..... 175/4.6; 166/55.1; 102/310; 102/320

(58) Field of Classification Search ..... 175/4.6; 102/310, 312, 313, 320; 166/297, 55.1
See application file for complete search history.

(56) References Cited

U.S. PATENT DOCUMENTS

| | | | | |
|---|---|---|---|---|
| 3,659,658 | A * | 5/1972 | Brieger | 175/4.6 |
| 4,391,337 | A * | 7/1983 | Ford et al. | 175/4.6 |
| 4,657,089 | A * | 4/1987 | Stout | 175/4.6 |
| 4,951,744 | A | 8/1990 | Rytlewski | |
| 5,088,557 | A * | 2/1992 | Ricles et al. | 166/297 |
| 5,598,891 | A * | 2/1997 | Snider et al. | 166/308.1 |
| 5,775,426 | A * | 7/1998 | Snider et al. | 166/308.1 |
| 6,158,511 | A * | 12/2000 | Wesson | 166/308.1 |
| 6,439,121 | B1 * | 8/2002 | Gillingham | 102/312 |

FOREIGN PATENT DOCUMENTS

| | | |
|---|---|---|
| CN | 2270115 | 12/1997 |
| CN | 2309419 | 3/1999 |
| CN | 2314091 | 4/1999 |
| CN | 2386194 | 7/2000 |
| CN | 2391987 | 8/2000 |

* cited by examiner

*Primary Examiner*—Hoang Dang
(74) *Attorney, Agent, or Firm*—Ladas and Parry LLP

(57) ABSTRACT

The invention relates to a perforating device comprising one or more perforating gun (1) installed in a perforating body (9), a perforating gun head (2) in the uppermost end of the perforating body (9), a perforating gun base (7) in the lowermost end of the perforating body (9) and a detonating device (3) installed inside or outside the perforating head (2), in which a charge frame (10, 22) is installed inside of the perforating body (9). A plurality of perforator unit connected each other by a detonating cord (15) are provided on the charge frame (10, 22). Every perforator unit comprises an explosive box (11) in a charge socket, a charge (13) in charge housing (12) and energy-bearing media (14). Moreover, an energy-bearing media sleeve (28) is provided outside of the perforating device. The perforating device is easy to manufacture with low cost and can be used securely in the operation.

17 Claims, 12 Drawing Sheets

HIGH-ENERGY COMBINED WELL PERFORATING DEVICE

FIELD OF THE INVENTION

The invention relates to an apparatus for producing petroleum, gas, water and the dissolvable or soluble materials or minerals from wells, in particular to a device for energy concentration and jet perforating.

BACKGROUND OF THE INVENTION

The Chinese utility model patent No. 97242235.8 under the title of "a high-energy combined overbalance high density double jet perforating device for oil-gas wells" employs a cylindrical powder sleeve or a solid-propellant sleeve, any of which has several charge sockets distributed in its different lengths and different phases and has a detonating cord hole used for inserting a detonating cord while a charge is mounted in the corresponding charge socket. The structure of the powder sleeve or the solid-propellant sleeve is difficult to realize through a certain manufacturing process, moreover before the down hole operation in the oil field it is required to cut the composite solid-propellant sleeve, which decreases the efficiency of assembling and increases the potential failure in safety.

In the above-mentioned patent, the pressure-relief vent is sealed with a circular steel plate which is covered by a sealing cap made of rubber layer and is inserted in the pressure-relief vent thus to achieve the sealing. Since the rubber layer of said sealing cap is only combined with the upper surface of the circular steel plate, under the action of pressure, temperature and chemical medium, said rubber layer is fallen off easily and loses its sealing function, then water may flow into the perforating gun, which may extinguish the detonating cord even a failure of gun explosion will happen.

Moreover, in the above-mentioned patent, the positioning mechanism between the charge strip and the perforating gun can only position the charge strip in the perforating gun radically and can not position the charge strip in the perforating gun axially which is not only detrimental to detonation propagation but also causes the shaped charges unable to align with the pressure-relief vent thus the jets produced through the detonation of the shaped charge may be deflected and is harmful to the quality of perforation as well as to the effect of the gas fracturing.

In addition, the inner surface of the gun bottom at the lowermost end of the perforating device is a planar surface and the space of the lowermost end of the perforating device is very small, in which after the explosion of the shaped charges and deflagration of the powder sleeve or the solid-propellant sleeve, a local pressure may build up enormously, resulting in an accident of gun explosion.

From above, the device according to the said patent is difficult to realize by means of a certain manufacturing process because of using the powder sleeve or the solid-propellant sleeve. In the meantime the down hole operation is hardly to meet a variety of underground conditions and it is impossible to achieve efficiently the effect of perforation and fracturing.

The invention is aimed at providing a high energy combined new perforating device for oil-gas wells. The device can efficiently increase the fracturing energy and can be manufactured through a simple process so as to be suitable for commercial production.

SUMMARY OF THE INVENTION

The object of the invention is to provide a high energy combined perforating device for oil-gas wells. The device can overcome the shortcomings of the above-mentioned patent and is easy to manufacture with low cost. Moreover the device has been designed more rationally and is convenient to assemble, to implement and to operate securely.

In order to achieve the above objects, the invention adopts such solution: the device comprises a one-section perforating gun or a multi-section perforating gun, a gun top at the upper end of the uppermost section of the perforating gun, a gun bottom at the lower end of the lower most perforating gun and an igniting device installed inside or outside of the gun top. The perforating gun features a charge strip being installed inside of the perforating gun body and a plurality of unit perforators connected one another by a detonating cord interlaced with the strip.

In said multisection perforating gun there is provided on the lower end of the upper section perforating gun with a lower connector having a built-in booster connected with a detonating cord and there is provided on the upper end of the neighboring lower section perforating gun with an upper connector having a built-in booster connected with a detonating cord, the upper section perforating gun and the lower section perforating gun being connected through the upper and lower connectors.

Said unit perforator comprises a charge socket installed radially in an explosive box, a charge housing in the charge socket, a charge in the charge housing, a detonating cord fixed on the positioning clip at the charge end and an energetic material in the explosive box.

Said energetic material is formed as an energetic material piece or material cylinder with an axially mounted hole for detonating cord, a detonating cord installed in the hole and connected with the shaped charges.

A screwed slot of detonating cord is provided on the lateral surface of the explosive box and the detonating cord is wound on the lateral surface of the explosive box along the screwed slot to connect with the clip end of the shaped charge.

Said detonating cord is installed in the perforating carrier and outside of a charge strip and is connected with the clip ends of the shaped charges.

At the axial length of the perforating carrier there are provided radially with a scallop and a pressure-relief vent opposite to the scallop, the neighboring scallops and pressure-relief vents of different axial lengths and different phases are arranged alternatively based on a same spiral direction, and the pressure-relief vent is covered with a sealing cap.

Said charge strip comprises a pair of charge sockets installed radially at a same axial length in a tabular body and being symmetrical to the axis, two neighboring charge sockets of different axial lengths and different phases are arranged alternatively and are in one-to-one correspondent to the scallops or the pressure-relief vents on the perforating carrier. In addition, there are charge strip positioning holes on the sidewalls of two ends of the tubular body.

Said perforating gun body has two radially opposite pressure-relief vents at a same axial length of the gun body.

Each of the pressure-relief vents is provided with an arched sealing cap.

The arched sealing cap is comprised of an arched steel plate, on top surface of which a rubber sealing ring has a cone angle $\alpha$ of 15~45°.

The arched sealing cap is comprised of a circular steel plate with its top surface chamfered an angle β of 30~60° and the top surface of the circular steel plate attached with a rubber gasket having a cone angle α of 15~45°. Since the rubber body at the cone angle of rubber gasket is pressed by the wall of the pressure-relief vent, the rubber gasket may not be fallen off from the circular steel plate, so it improves the reliability of sealing.

A positioning mechanism is installed between the upper, lower end of the charge strip and the perforating carrier. The positioning mechanism is used in restricting the charge strip to rotate and to move axially relatively to the perforating carrier and comprises a positioning ring provided in the perforating carrier with two ends of the ring fixedly connected with the charge strip through a connecting member; a positioning key with its one end fixed on the positioning ring and its other end installed in a positioning slot on the carrier; and a limiting screw cap mounted outside the positioning ring.

Said positioning ring is provided with positioning ring and positioning hole radially on the side wall of the positioning ring with the connecting member inserted into the positioning hole and a charge strip positioning hole on the end of the carrier, the circular ring end surface of the positioning ring being fabricated or prepared as to have a positioning slot for receiving the positioning key.

Said shaped charge strip comprises at its same axial length a tail hole and a unit perforator window through machined radially, the window takes a shape of rectangle with its center line to coincide with the center line of the tail hole at the same axial length. The neighboring tail hole and unit perforator window of different lengths and different phases are arranged alternatively according to a same spiral direction. The positions of the tail hole of different axial lengths and different phases are in one-to-one correspondence with the pressure-relief vents of the perforating carrier, and the positions of the unit perforator are in one-to-one correspondence with the scallops on the perforating carrier. On both sides along the axial direction of the unit perforator, there are formed respectively a locking slot while there is provided a charge positioning hole on each sidewall of both ends of the charge strip.

The unit perforator is mounted in the unit perforator window of the charge strip and comprise a variable diameter charge socket positioned in the axial middle of the explosive box and two locking sheets formed radially with each provided at an axial end and outside of the explosive box and being able to lock the explosive box (23) in the unit perforator window (9'), a detonating cord slot formed on the outer cylindrical surface of the explosive box, a charge installed in the charge socket of the explosive box, the space of the explosive box being provided with the energetic material and the detonating cord being positioned in the detonating cord slot and connected with the ends of the shaped charges.

A pressure-relief slot is provided in the gun bottom.

The perforating carrier of 1 meter long has 5~20 unit perforators along with the shaped charge strip.

In another aspect of the present invention, there is provided a high energy combined perforating device for oil-gas wells. The device comprises a one-section perforating gun or a multi-section perforating gun, a perforating gun top in an upper end of the uppermost section perforating gun, a perforating gun bottom in a lower end of the lowermost section perforating gun, and the device comprises also an igniting device installed inside or outside of the perforating gun top; the perforating carrier contains in its body a charge strip with unit perforators connected one another by a detonating cord. A positioning mechanism is provided between the upper, lower ends of the charge strip and the perforating carrier, moreover, a pressure-relief slot or a recess is provided in the gun bottom.

In a further aspect of the present invention there is provided a high-energy combined perforating device for oil-gas wells. The device comprises a one section perforating gun or a multi-section perforating gun, a perforating gun top at an upper end of the uppermost section perforating gun, a perforating gun bottom at a lower end of the lowermost section perforating gun, and the device comprises also an igniting device installed inside or outside of the perforating gun top; the perforating gun comprises in its body a charge strip provided with unit perforators, the unit perforators are connected one another by a detonating cord. A positioning assembly is provided between the upper, lower ends of the charge strip and the perforating carrier, moreover, a pressure-relief slot or a recess is provided in the gun bottom.

In a still further aspect of the present invention there is provided a high-energy combined perforating device for oil-gas wells. The device comprises a one-section perforating gun or a multisection perforating gun, a perforating gun top at an upper end of the uppermost section perforating gun, a perforating gun bottom at a lower end of the lowermost section perforating gun top, and the device comprises also an igniting device installed inside or outside of the perforating gun top; the perforating gun comprises in its body a charge strip with a built-in charge box provided with a shaped charge. A high energetic solid material is provided between a charge box and a neighboring box, and a detonating cord is connected with each charge. In addition, a positioning assembly is provided between the upper, lower ends of the shaped charge strip and the perforating carrier.

In comparison with the Chinese utility model patent No. 97242235.8, the present invention changes the powder sleeve or the solid-propellant sleeve into a unit perforator constructed from an explosive box in which energetic material is contained. The unit perforator can be manufactured with a simple technique and is suitable for a commercial production and is convenient to be assembled when utilized, thus the difficulty in manufacturing the powder sleeve or the solid-propellant sleeve is solved and the problem of having to cut the solid-propellant that will decrease the efficiency of assemble and increase the potential failure in safety can be avoided. Therefore the present invention is featured by its simple process and is suitable for a commercial production.

The present invention changes the circular steel plate for covering the pressure-relief vent into an arched steel plate or a chamfered circular steel plate. The arched steel plate or the chamfered circular steel plate is attached with a rubber sealing material which may improve the resistance to deformation and insure good sealing for the down hole perforating gun.

The present invention can also change one of the two pressure-relief vents into a scallop, which may decrease the seal requirements without influencing the pressure-relief area of the perforating carrier.

According to the present invention, the positioning mechanism at each end of the shaped charge strip makes the strip able to position in the perforating gun axially and radially and insures the charges to be one-to-one corresponding to the scallops as well as the pressure-relief vents, which assures the quality of perforation and the effect of gas fracturing.

According to the present invention, there is formed a pressure-relief slot in the inner surface center of the gun bottom in the lowermost section perforating gun, which decreases a local pressure near the gun bottom and insures the safety in the operation of the perforating device.

Therefore, the present invention has such advantages as a rational design, a compact structure, convenience to implement, easy assembling, safety and reliability, and to improve the effect of perforation and fracturing. The invention can be widely used in oil wells, gas wells and water wells.

DESCRIPTION OF THE EMBODIMENTS

The invention will be described in detail in connection with the embodiments by referring to the accompanying drawings.

FIGS. 1~9 show schematically the structure of the first embodiment according to the invention.

Figure 1:
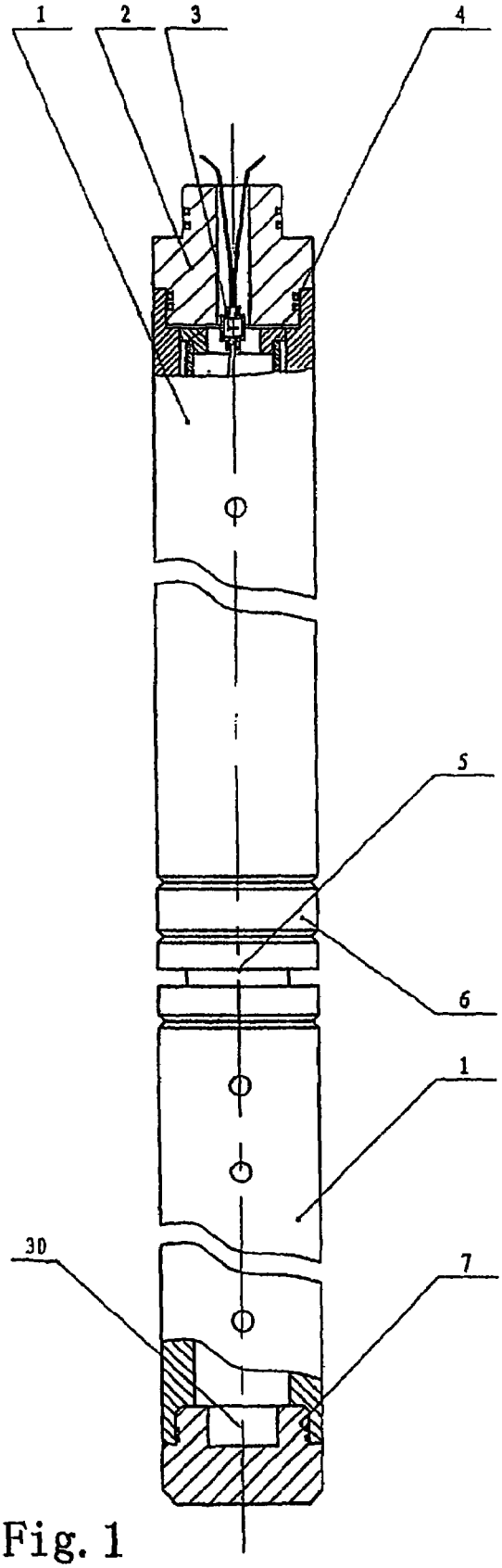
FIG. 1 is a diagram showing the structure of one embodiment according to the invention.
Figure 2:
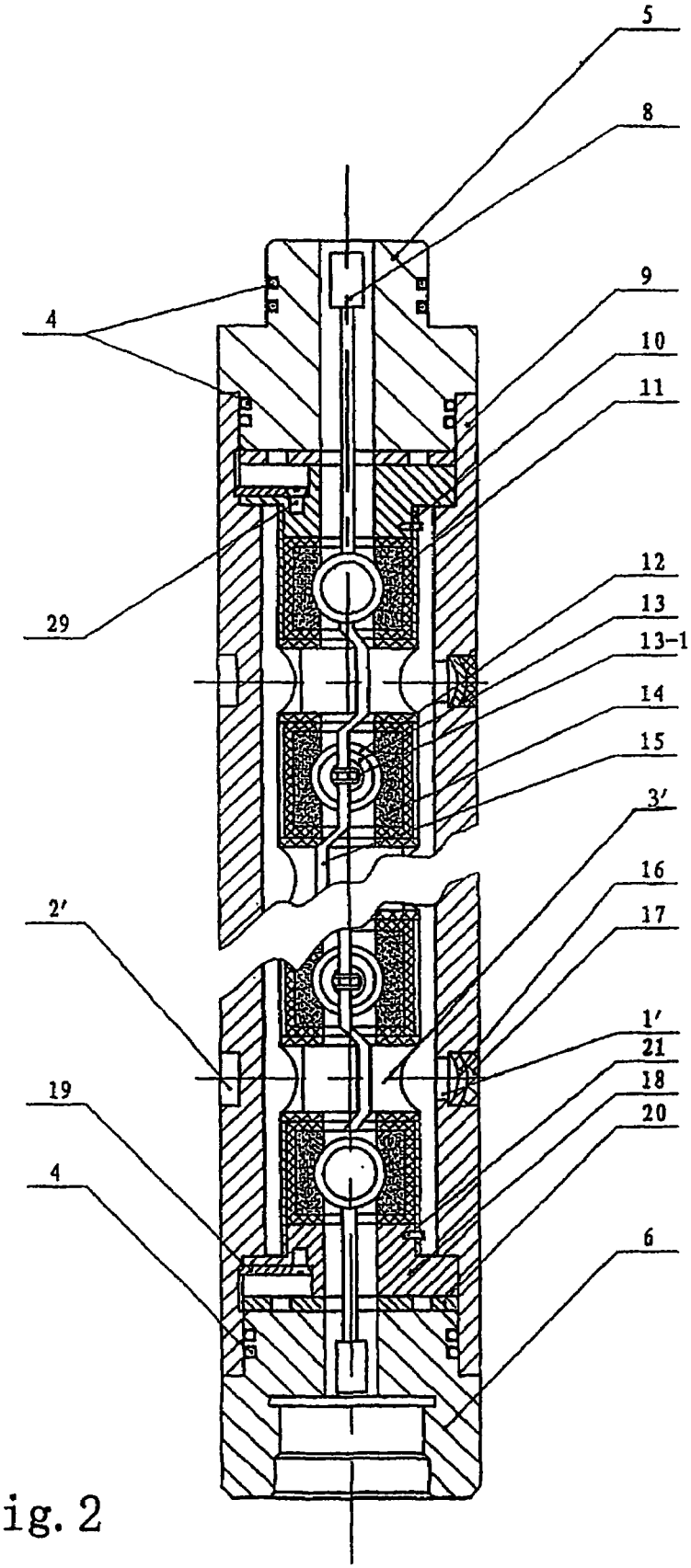
FIG. 2 is a diagram showing the structure of one section of perforating gun 1 in FIG. 1.

In FIG. 1 and FIG. 2, the embodiment is constructed through connecting together a two-section perforating gun 1, a gun top 2, an igniting unit 3, a rubber gasket 4, an upper connector 5, a lower connector 6, a gun bottom 7 and a booster 8. An upper end of the top most section perforating gun 1 is connected with the gun top 2 and its lower end is connected with an upper end of the lower section perforating gun 1 through the lower connector 6 and the upper connector 5, the rubber gasket 4 is installed between the upper connector 5 and the lower connector 6 as well as between the gun top 2 and the perforating gun 1, the lower end of the lowermost section perforating gun 1 is connected with the gun bottom 7, the detonator igniting unit 3 is installed in the gun top 2 and connects with a ground power supply through a cable, in addition, a booster 8 is mounted in the upper connector 5 and the lower connector 6. The two-section perforating gun 1 may have different lengths. Moreover, the present embodiment can choose a one-section perforating gun 1 with its upper end to connect the gun top 2 and its lower end to connect the gun bottom 7. The one-section perforating gun according to the present invention may have a variety of sizes with a length of 0.5~4 m. In practice, one can select the perforating gun of desired length from the variety of sizes of the perforating gun 1 based on the thickness of the perforating intervals targeted, then to connect it with the upper connector 5 and the lower connector 6 where in the upper end of the uppermost section perforating gun 1 being connected with the gun top 2 and the lower end of the lower most section perforating gun 1 being connected with the gun bottom 7. If the perforating section has a thickness of 10.5 m, one can choose a two-section perforating gun 1 with the length of one section being 4 m and a one-section perforating gun 1 of a length 2.5 m to assemble another embodiment of the invention. In addition, there exists between the upper and the lower perforating sections an interval without the necessity of perforating, the upper and lower perforating sections can be chosen from the variety of sizes of the perforating guns 1, the interval without the necessity of perforating uses a spacer. Between the one perforating gun and the other perforating gun, the one spacer and the other spacer, the perforating gun and the spacer, in each case the connection can be formed through the upper connector 5 and the lower connector 6.

FIG. 2 schematically shows the structure of the one-section perforating gun 1 according to the embodiment. In FIGS. 1 and 2, the one-section perforating gun 1 is constructed through connecting together a perforating gun body 9, a charge strip 10, an explosive box 11, a charge housing 12, a charge 13, an energetic material 14, a detonating cord 15, and arched cap 16, a positioning ring 18, a positioning key 19, a screw cover 20, screws 21 and 29, wherein the explosive box 11, the charge housing 12, the charge 13 and the energetic material 14 connect together as a unit perforator of the embodiment; the charge strip 10, the positioning ring 18, the positioning key 19, the screw cover 20 and the screws 21 and 29 combine as a positioning mechanism of the embodiment.

Figure 3:
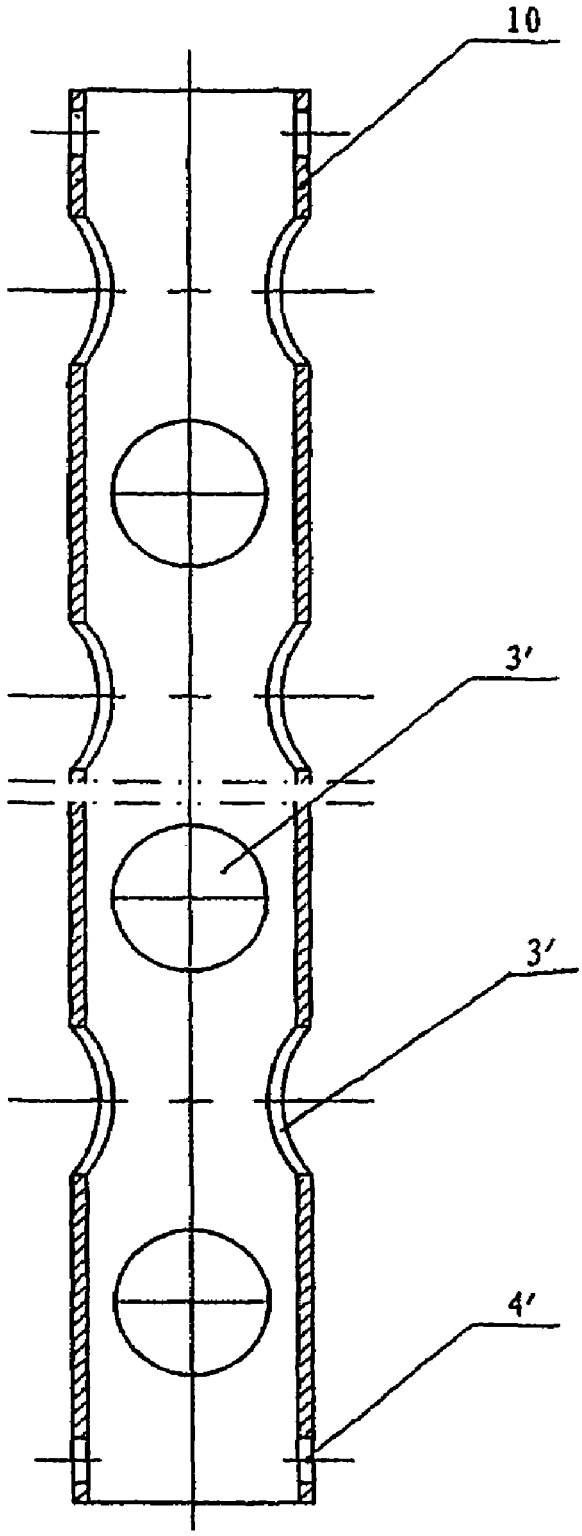
FIG. 3 is a diagram showing the structure of the shaped charge strip 10 in FIG. 2.

The charge strip 10 is installed in the perforating gun body 9. The charge strip 10 of the embodiment is of a cylinder shape. A pair of charge sockets 3' is formed radially at the same axial length of the charge strip 10 and is symmetric to the central axis as shown in FIG. 3. The one charge socket 3' is in correspondence with a scallop 2' on the perforating gun 9 and the other charge socket 3' is in correspondence with a pressure-relief vent 1' at the same axial length, as shown in FIG. 2. Two neighboring charge sockets 3' of different axial lengths and different phases are arranged alternatively according to a same spiral direction with a phase angle of 90°. There is provided on each end of the charge strip 10 a frame charge-positioning hole 4'. In the embodiment, the charge strip 10 in the perforating carrier 9 of 1 m length is provided with 16 pairs of charge sockets 3' in different axial lengths and different phases. Both the length of charge strip 10 and the number of charge sockets are increased or decreased proportionally to the increasing or decreasing of the length of perforating gun 1.

Figure 4:
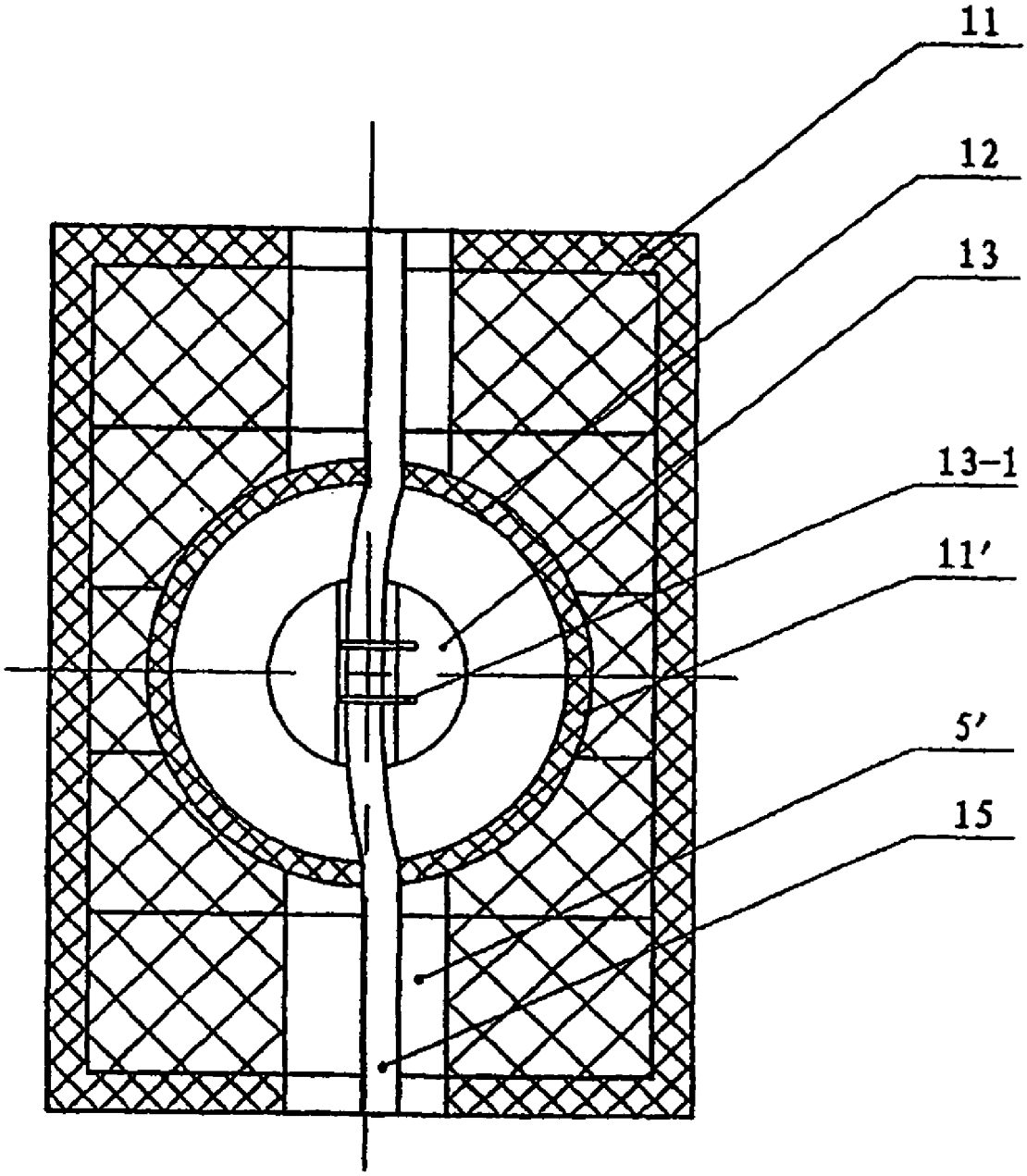
FIG. 4 is a diagram showing the structure of a unit perforator in FIG. 2.

There are 16 unit perforators installed in the charge strip 10 and each perforator is formed through connecting together the explosive box 11, the charge housing 12, the charge 13, the energetic material and the detonating cord 11, as shown is FIG. 4, on the explosive box 11 and at a same axial length there are formed radially a pair of charge sockets 11' symmetric to the central axis. The charge housing 12 containing a shaped charge 13 is installed in each charge socket 11' of the explosive box 11. The opening end of the charge 13 just opposes against the scallop 2' on the perforating carrier 9 and the clip end of the charge 13 is just opposite to the pressure-relief vent 1' being in correspondence with the scallop 2' at the same axial length. The energetic material 14 is arranged within the charge housing 12 in the explosive box 11 and a detonating cord hole 5' is positioned in the center of the energetic material 14. The detonating cord 15 inserts the detonating cord hole 5' of the energetic material 14 in each unit perforator. The detonating cord 15 is fixed on the clip end of the charge 13 by means of a positioning clip 13-1 mounted on the end of the charge 13. It is also possible to form a screwed slot on the outer surface of the explosive box 11 with the detonating cord 15 positioned in the slot. The detonating cord 15 can be also mounted in a space between the outer of the charge strip 10 and the inner of the perforating carrier 9 and connected to the end of charge 13 by overlapping. Since the present invention adopts the unit perforator comprising the explosive box 11—filled with the energetic material 14. This technique makes it unnecessary to manufacture a solid-propellant sleeve of 0.5~4 m long. Through the application of the present invention, in an operation of perforation fracturing down hole, when the thickness of a perforating interval is shorter than the whole length of several sections of the perforating gun 1, operators can decrease the number of unit perforators to achieve the perforating length identical to the length of the perforation interval, which solves the difficulty of having to cut a section of the composite solid-propellant sleeve on site.

Figure 5:
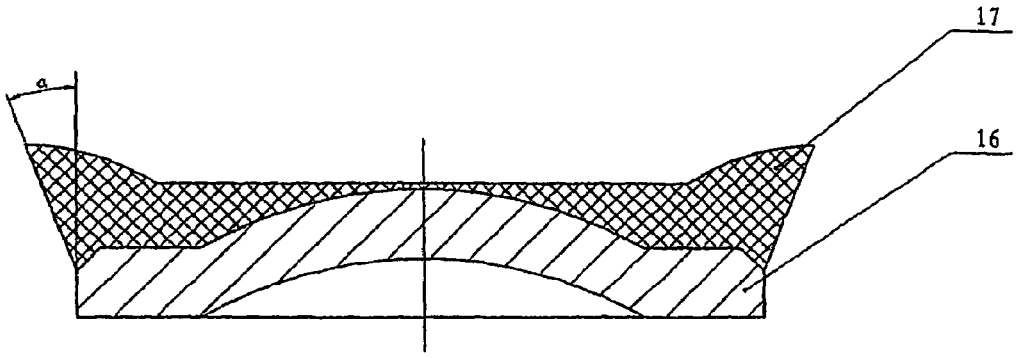
FIG. 5 is a diagram showing the structure of the sealing cap in FIG. 2.

At a same axial length of the perforating gun body 9, there are formed radially a scallop 2' and a pressure-relief vent 1', the pressure-relief vent 1' being opposite to the scallop 2' and used for relieving a pressure. In the present embodiment, on different axial lengths and different phases of the perforating gun body in 1 m of length, there are formed sixteen scallops 2' and sixteen pressure-relief vents 1'. Both a scallop 2' and a neighboring scallop 2' of different lengths and different phases are arranged alternatively based on a same spiral direction with a phase angle of 90°. The pressure-relief vent 1' is covered with a sealing cap. In the present embodiment, the sealing cap is made of an arched steel plate 16 attached with a rubber gasket 17 having a cone angle $\alpha$ of 30° as shown in FIG. 5.

Figure 6:
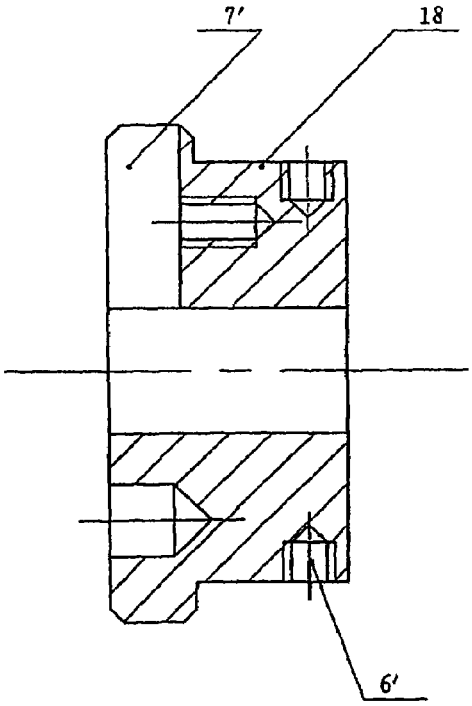
FIG. 6 is a cross-section view of the positioning ring 18 in FIG. 2.
Figure 7:
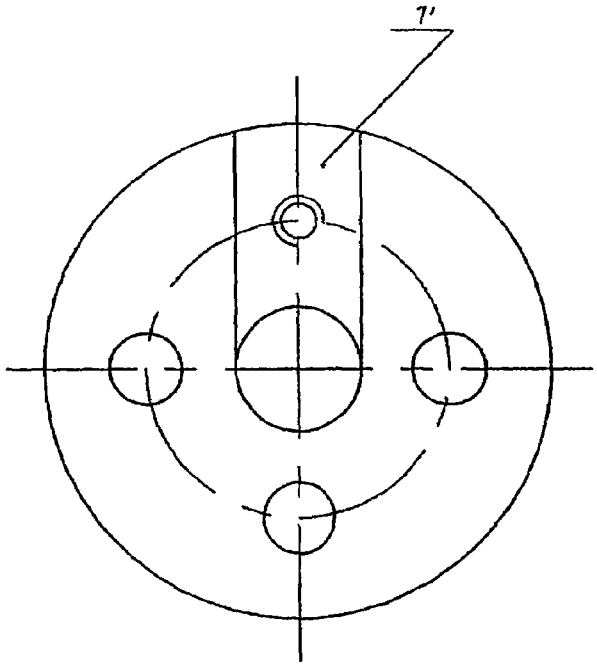
FIG. 7 is a left view of FIG. 6.
Figure 8:
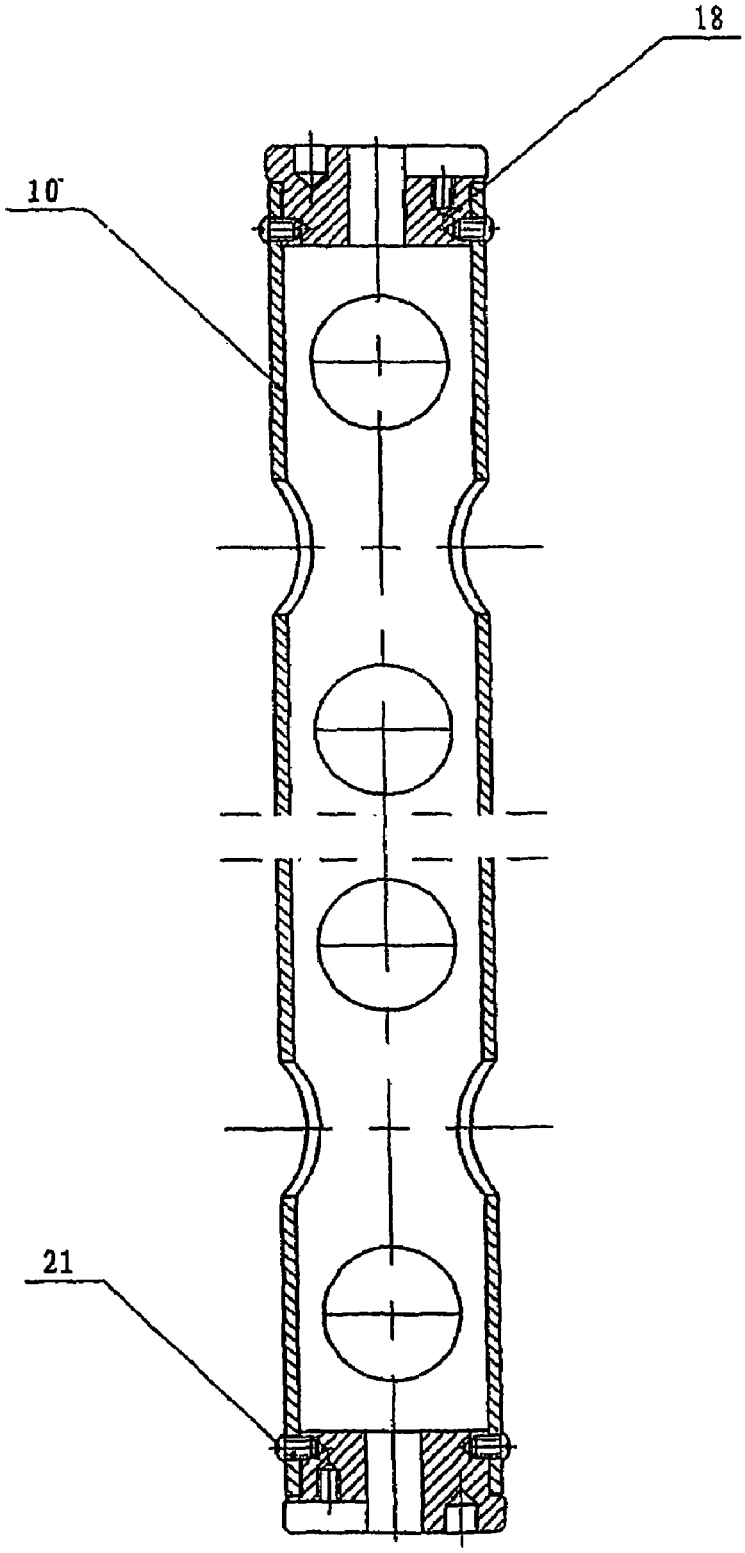
FIG. 8 is a diagram showing the connection between the positioning ring 18 and the charge strip 10.
Figure 9:
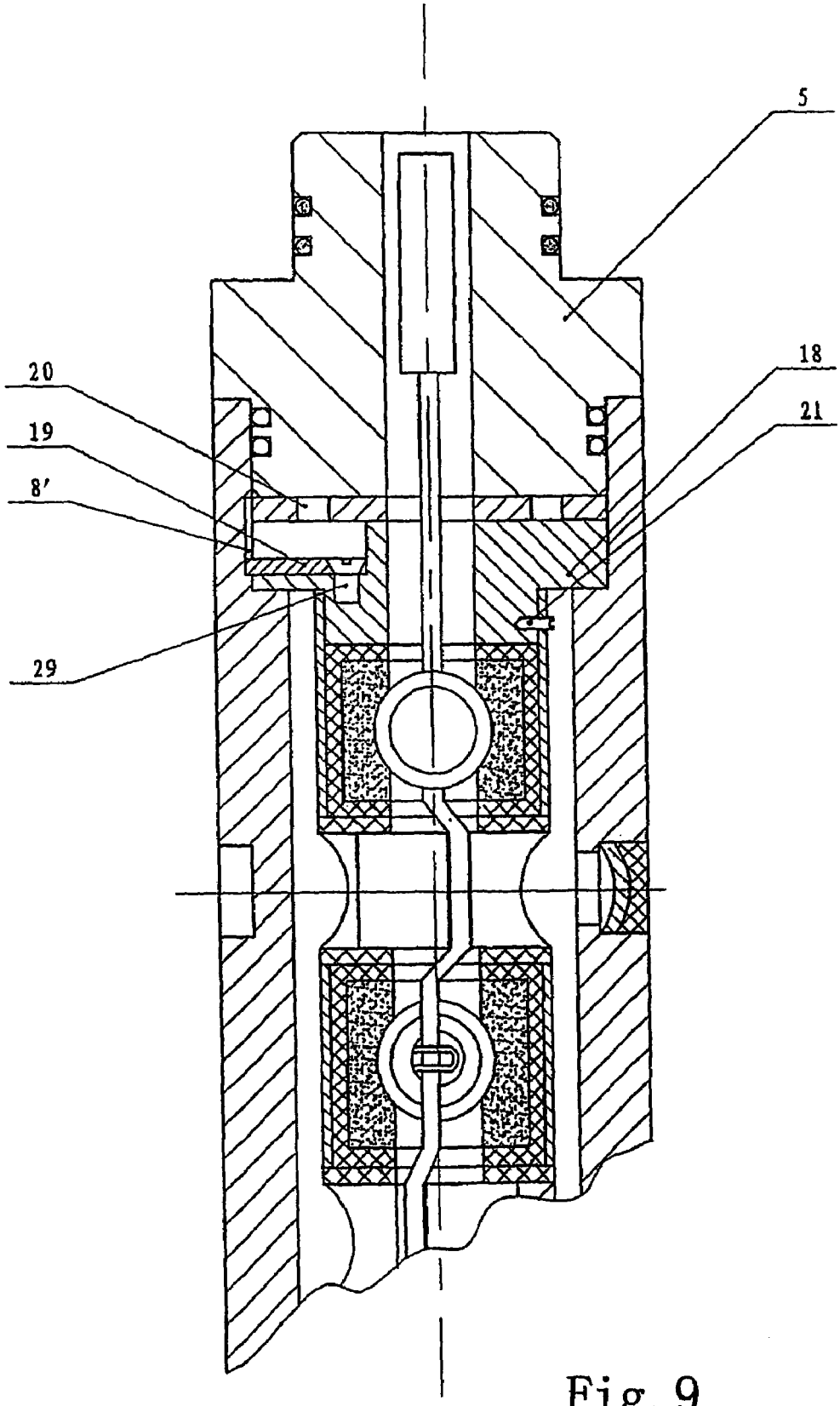
FIG. 9 is a diagram showing the connection between the positing mechanism and the charge strip 10 as well as the perforating carrier 9.

Between each end of the charge strip 10 and the perforating carrier 9 there is installed respectively a positioning mechanism as shown in FIG. 9. A positioning ring 18, a positioning key 19, a screw cover 20, a screw 21 and a screw 29 together forms the positioning mechanism of the embodiment. On the side wall of the positioning ring 18 there are formed radially two positioning holes 6' for the positioning ring, as shown in FIG. 6, the positioning holes 6' are all screwed holes. Inserting the screw 21 into the carrier positioning hole 4, as shown in FIG. 6, the positioning hole 6' for positioning ring is a screwed hole, then as shown in FIG. 3, the screw 21 is again screwed in the positioning hole 6' which makes the positioning ring 18 and the charge strip unable to rotate relatively as shown in FIG. 8. On the outer surface of the positioning ring 18 there is formed radially a positioning slot 7' for the positioning ring 18. The positioning slot 7' takes a shape of rectangle as shown in FIGS. 6 and 7. In the positioning slot 7' there is formed a screwed hole. The positioning key 19 is shaped as a rectangle as shown in FIG. 9, with its one end fixed in the screwed hole of the positioning slot 7' for the positioning ring 18 by means of the screw 29 and its other end being able just inserted in the gun body positioning slot 8' of the perforating gun body 9 to cause the carrier 10 and the perforating gun body 9 unable to rotate radially relatively to each other. Three holes are formed on the surface of the positioning ring 18 which are used to receive rotating means to rotate the positioning ring 18 so that the positioning key 19 is aligned with the positioning slot 8' on the gun body 9 to bring the head of the charge 13 in alignment with the scallop 2' of the gun body 9 as shown in FIG. 2. Through mounting the charge strip in the gun body 9 and screwing the screw cover 20 into each end of the gun body 9, the charge strip 10 cannot be moved axially relatively to the carrier 9. By the above-mentioned positioning mechanism, in the embodiment the charge strip 10 cannot be rotated radially and moved axially relatively to the gun body 9 thus insuring the perforating quality and the effect of gas fracturing.

As shown in FIG. 1, there is provided a pressure-relief slot 30 in the gun bottom 7 in order to decrease a local pressure build up for the gun body 9 and the gun bottom 7 to protect the perforating gun itself.

The inventor of the present invention provides a second embodiment of the invention. In the second embodiment, there are formed on the perforating gun body 9 (1 m in length) five scallops 2' and five pressure-relief vents 1' each of them opposite to corresponding scallops 2'. These scallops 2' and pressure-relief vent 1' are distributed on different axial lengths with different phases. The scallop 2' and a neighboring scallop 2' or a pressure-relief vent 1' of different axial lengths are arranged alternatively in a same spiral direction with a phase angle of 90°. The pressure-relief vent 1' is covered with a sealing cap and the sealing cap is comprised of an arched steel plate 16 attached with a rubber gasket 17, which has a cone angle $\alpha$ of 15°. A charge housing 3' of the charge strip 10 in the perforating gun body 9 is in correspondence with the scallop 2' or the pressure-relief vent 1'. In the charge strip 10 there are installed five unit perforators with the other elements as well as their connecting relations being the same as in the first embodiment.

In a third embodiment according to the invention, on the perforating gun body 9 (1 m in length) there are formed twenty scallops 2' and twenty pressure-relief vents 1' opposite to the scallops 2' of different axial lengths and different phases. The scallop 2' and a neighboring scallop 2' or a pressure-relief vent 1' are arranged alternatively in a same spiral direction with a phase angle of 90°. The pressure-relief vent 1' is covered with a sealing cap and the sealing cap is comprised of an arched steel plate 16 attached with a rubber gasket 17, which has a cone angle $\alpha$ of 45°. A charge housing 3' of the carrier 10 in the perforating gun body 9 is in correspondence with the scallop 2' or the pressure-relief vent 1'. In the charge strip 10 there are installed twenty unit perforators with the other elements as well as their connecting relations being the same as in the first embodiment.

Figure 10:
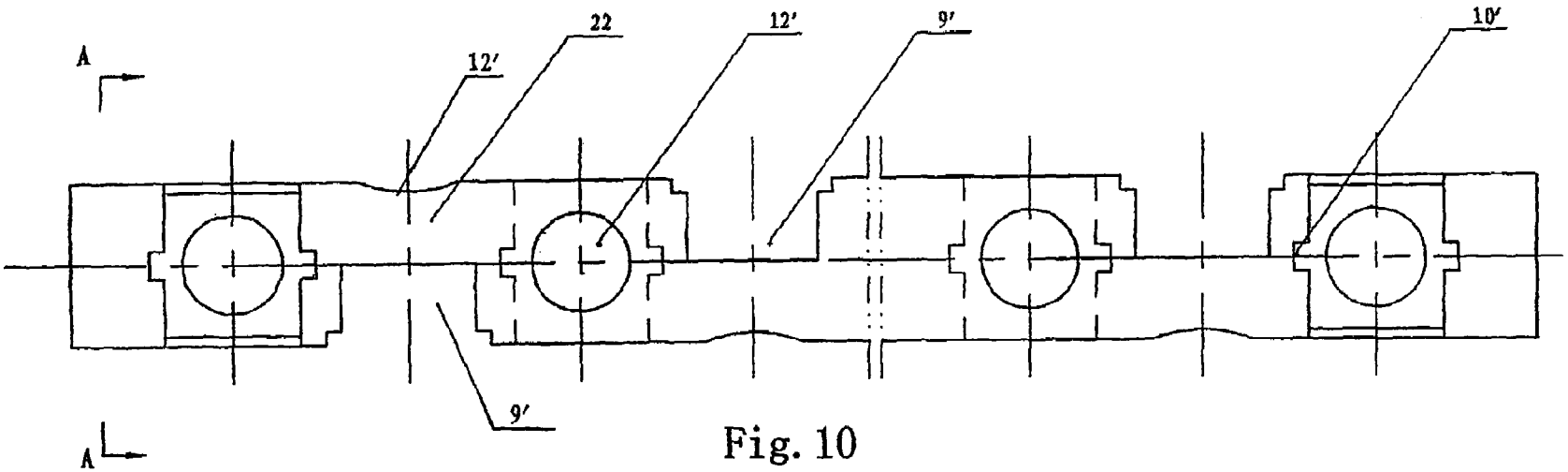
FIG. 10 is a diagram showing the structure of the charge strip 22 in the fifth embodiment of the invention.
Figure 11:
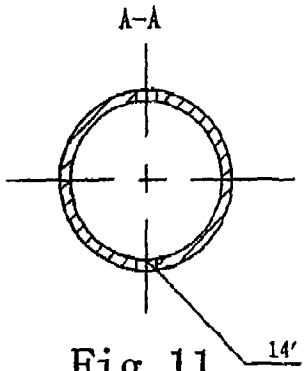
FIG. 11 is the A—A cross-section view of FIG. 10.
Figure 13:
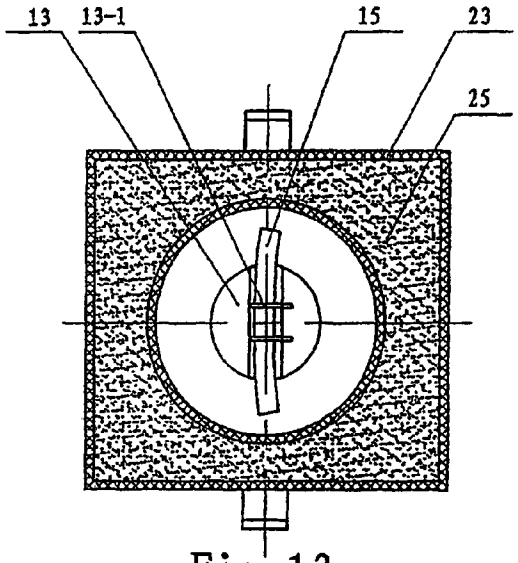
FIG. 13 is a cross-section view showing the charge of FIG. 12 in an intact state with an explosive box showing in a cross-section view along the line B—B.
Figure 12:
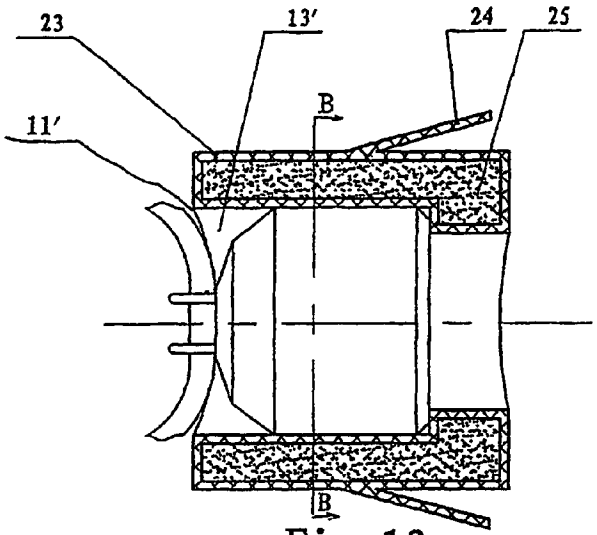
FIG. 12 is a side sectional view of a unit perforator in the fifth embodiment of the invention with the charge in an uncut state.
Figure 14:
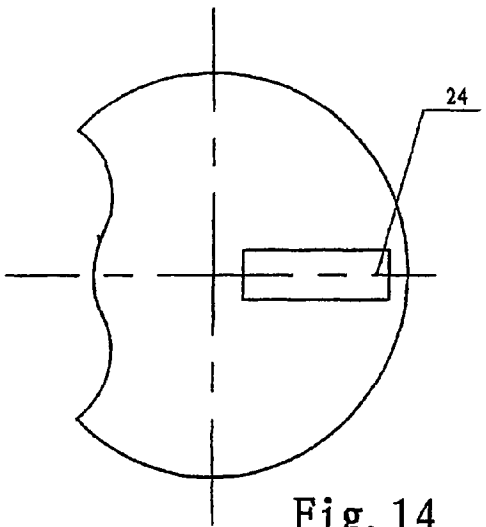
FIG. 14 is a top view of the explosive box in FIG. 12.

In a fourth embodiment according to the invention, as shown in FIGS. 2, 10, 11, 12, 13 and 14, the charge strip 22 is another form of such a charge strip, at its same axial length there are formed radially a tail hole 12' and a unit perforator window 9', the unit perforator window 9' takes the shape of a rectangle and its center line coinciding with the center line of the tail hole 12' as shown is FIG. 10. The positions of tail hole 12' in different axial lengths and different phases are in one-to-one correspondence with the pressure-relief vents 1' on the perforating gun body 9. Two neighboring tail holes 12' and unit perforator window 9' of different axial lengths and different phases are arranged alternatively with a phase angle of 90°. On each of both sides along the axial direction of the unit perforator window 9' there is provided with a locking slot 10'. The unit perforator window 9' is used to position the unit perforator. In the present embodiment, on the charge strip 22 in length of 1 m there are provided with sixteen tail holes 12' and sixteen unit perforator windows 9'. Both the length of the charge strip 22 and the number of the tail holes 12' on the charge strip 22 as well as the number of the unit perforator window 9' are increased or decreased proportionally to the increasing or decreasing of the length of perforating gun 1. On each end of the charge strip 22 there is formed a charge strip positioning hole 14' for mounting a positioning mechanism, as shown in FIG. 11. The unit perforator of the present embodiment is comprised of a explosive box 23, a locking sheet 24, a charge 13, an energetic material 25 and a detonating cord 15, as shown in FIGS. 12, 13 and 14. A diameter variable charge socket 13' is formed radially in the axial middle of the explosive box 23 the outer surface of each axial end of the explosive box 23 is riveted with the locking sheet 24, which in the present embodiment is a spring spacer. One end of the locking sheet 24 as mentioned above is riveted on the axial end surface of the explosive box 23 and the other end of it is a free end. When the explosive box 23 is installed in the unit perforator window 9' of the charge strip, the locking sheet 24 is just clamped into the locking slot 10' on each side of the unit perforator window 9' in the charge strip 22, as shown in FIG. 10. The explosive box 23 is fixed in the unit perforator 9' of the charge strip 22. On the axial outside of the explosive box 23 there is formed a detonating cord slot 11'. A charge 13 is installed in the charge socket 13', the opening end of the charge 13 aligns with the unit perforator window 9' on the carrier 11 and the scallop 2' on the perforating gun body 2' at the same axial length while the clip end of the charge 13 is in alignment with the pressure-relief vent 1' at the same axial length on the perforating gun body. The space in the explosive box 23 contains the energetic material 25, which in the present embodiment may also be formed into a sheet. A detonating cord 15 is mounted in the detonating cord slot 11' on the outer surface of the explosive box 23 and is overlapped with the clip end of the charge 13 meanwhile is wound helically along the inner wall of the charge strip. In the present embodiment, the other elements and their connecting relations are the same with the first embodiment. The assembly in the invention is simpler since the present embodiment adopts the above-mentioned structured charge strip 22 and the unit perforator.

In the fifth embodiment according to the invention, at a same axial length on the charge strip 22 there are formed radially a tail hole 12' and a unit perforator window 9' shaped as a rectangle with its center line to coincide with the center line of the tail hole 12' at the same axial length. On the charge strip 22 in length of 1 m there are formed five tail holes and five unit perforator windows 9'. Each of the unit perforator windows 9 receives a unit perforator. The tail holes 12' and the unit perforator windows 9 on the charge strip 21 are arranged in the same order as in the fourth embodiment, moreover the structure of the unit perforator is also the same as in the fourth embodiment.

In the sixth embodiment according to the invention, at a same axial length on the charge strip 22 there formed radically a tail hole 12' and a unit perforator window 9 shaped as a rectangle with its centerline to coincide with the centerline of the tail hole 12' at the same axial length. On the charge strip 22 in length of 1 m there are formed twenty tail holes and twenty unit perforator windows 9'. Each of the unit perforator windows 9 receives a unit perforator. The tail holes 12' and the unit perforator windows 9 on the charge strip 21 are arranged in the same order as in the fourth embodiment, moreover the structure of the unit perforator is also the same as in the fourth embodiment.

Figure 15:
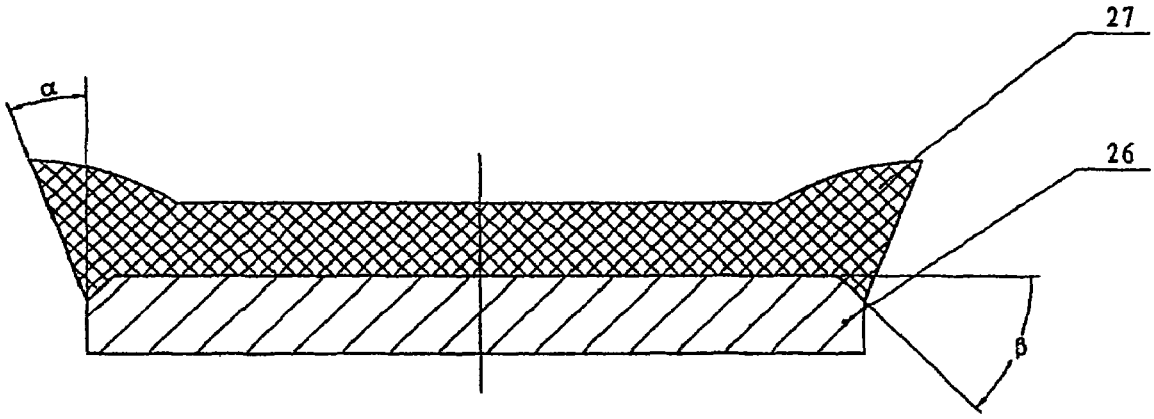
FIG. 15 is a diagram showing the sealing cap of the eighth embodiment according to the invention.
Figure 16:
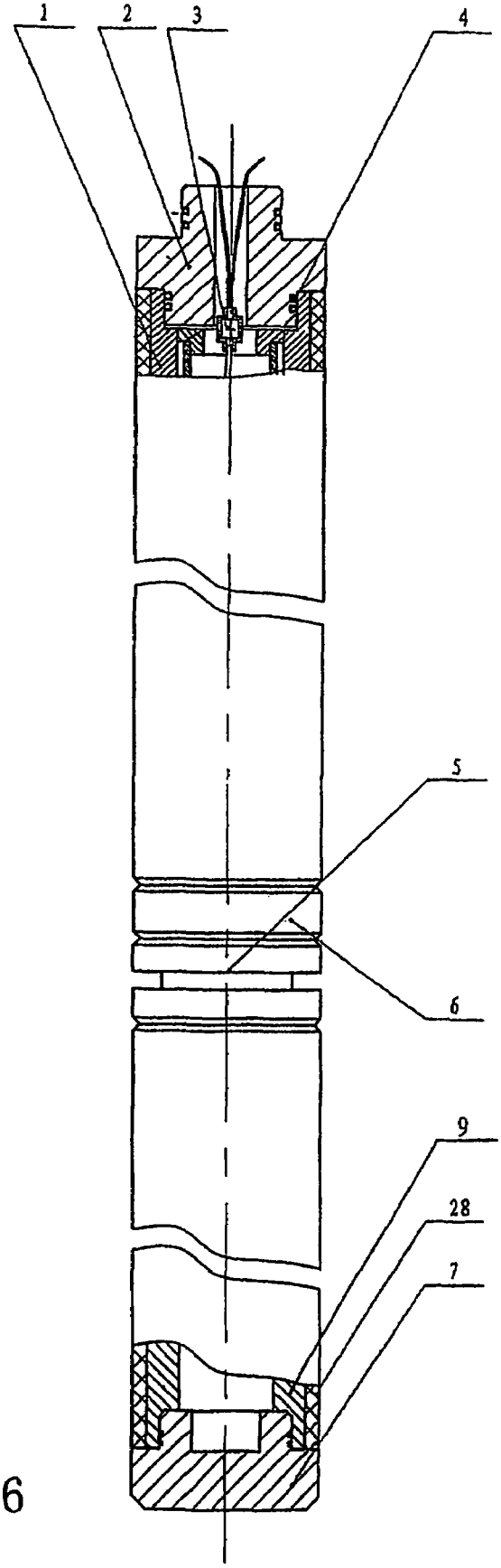
Figure 17:
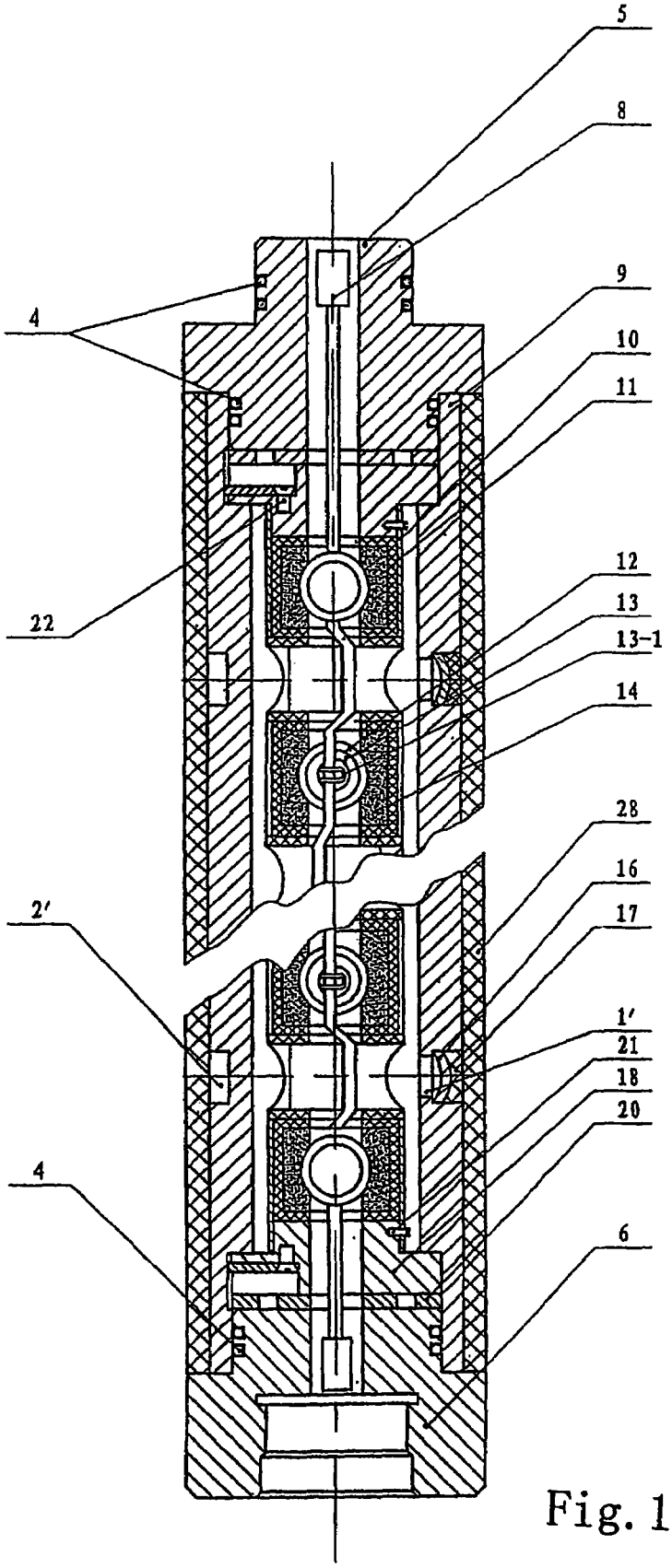

In the seventh embodiment according to the present invention, as shown in FIG. 2 and FIG. 15, the sealing cap covering the pressure-relief vent 1' of the perforating carrier 9 is comprised of a circular plate 26 attached with a rubber gasket 27. The surface of the circular plate 26 has a chamfer angle β of 50° shown as in FIG. 15 and the other elements as well as their connecting relations are the same as in the first embodiment.

In the eighth embodiment according to the present invention, the surface of the circular plate 26 on the sealing cap has a chamfer β of 60° and the top surface of the circular plate is attached with the rubber gasket 27. The other elements and their connecting relations are the same as in the first embodiment.

In the ninth embodiment according to the present invention, the surface of the circular plate 26 on the sealing cap has a chamfer β of 45° and the top surface of the circular plate is attached with the rubber gasket 27. The other elements and their connecting relations are the same as in the first embodiment.

What is claimed is:

1. A high energy combined perforating device for oil-gas wells, comprising a one-section perforating gun or a multi-section perforating gun (1), a perforating gun top (2) provided at an upper end of an uppermost section perforating gun (1), a perforating gun bottom (7) provided at a lower end of a lowermost perforating gun (1), an igniting device (3) inside or outside of the perforating gun top (2), a charge strip (10, 22) installed in a perforating carrier (9), a plurality of unit perforators mounted in the charge strip (10, 22) and a detonating cord (15) connects with each of the unit perforators, said energetic material (14) being formed as granular material or solid piece which is provided axially with a detonating cord hole (5'), the detonating cord (15) being installed in the detonating cord hole (5') and connected with ends of shaped charges (13) of a perforating charge.

2. The high energy combined perforating device for oil-gas wells as claimed in claim 1, wherein for said multisection perforating gun (1) there is provided on a lower end of an upper section perforating gun (1) a lower connector (6) having a built-in booster (8) connected with the detonating cord (15) and there is provided on an upper end of a neighboring lower section perforating gun (1) an upper connector (5) having a built-in booster (8) connected with the detonating cord (15), the upper section perforating gun (1) and the lower section perforating gun (1) being connected through the upper and lower connectors (5, 6).

3. The high energy combined perforating device for oil-gas wells as claimed in claim 1, wherein each said unit perforator comprises a charge socket (11') installed radially in an explosive box (11), a charge housing (12) provided in the charge socket (11'), said perforating charge (13) being in the charge housing (12), the detonating cord (15) being fixed on a positioning clip (13-1) and the energetic material (14) being provided in the explosive box (11).

4. The high energy combined perforating device for oil-gas wells as claimed in claim 3, characterized in that a screwed slot for the detonating cord is provided in a lateral surface of the explosive box (11) and the detonating cord (15) is wound on the lateral surface of the explosive box (11) along the screwed slot to connect with the base of a charge (13).

5. The high energy composite perforating device for oil-gas wells as claimed in claim 3, characterized in that said detonating cord (15) is installed in a body of the perforating gun (9) and outside of the perforating carrier (9), and is connected with a base of the charge (13).

6. The high energy composite perforating device for oil-gas wells as claimed in claim 1, characterized in that at an axial length of the perforating gun body (9) there are provided radially a scallop (2') and a pressure-relief vent (1') in an opposite direction to said scallop, said scallop (2') and pressure-relief vent (1') being of different axial lengths and different phases and are arranged alternatively based on a common spiral direction, and the pressure-relief vent (1') is covered with a sealing cap.

7. The high energy combined perforating device for oil-gas wells as claimed in claim 1, characterized in that said charge strip (10) comprises a pair of charge sockets (3') installed radially at a same axial length in a tubular body and are symmetrical to a central axis of the tubular body, two neighboring charge sockets (3') being of different axial lengths and different phases and are arranged alternatively and in one-to-one correspondence with scallops (2') or pressure-relief vents (1') on a respective perforating gun (9), and charge strip positioning holes (4') are provided on side walls of both ends of the tubular body.

8. The high energy combined perforating device for oil-gas wells as claimed in claim 6, characterized in that said perforating gun body (9) has two radially opposite pressure-relief vents (1') at an axial length of the gun body (9).

9. The high energy combined perforating device for oil-gas wells as claimed in claim 8, characterized in that each of said pressure-relief vents (1') on the perforating gun body (9) is provided with an arched sealing cap.

10. The high energy combined perforating device for oil-gas wells as claimed in claim 9, characterized in that said arched sealing cap comprises an arched steel plate (16) with rubber gasket (17) attached on its top surface, said rubber gasket (17) having a cone angle a of 15~45°.

11. The high energy combined perforating device for oil-gas wells as claimed in claim 9, characterized in that said arched sealing cap comprises a circular steel plate (26) with a top surface chamfered at an angle b of 30~60° and attached to the top surface of the circular steel plate (26) is a rubber gasket (27) having a cone angle of 15~45°.

12. The high energy combined perforating device for oil-gas wells as claimed in claim 1, characterized in that a positioning mechanism is installed between the upper, lower ends of the charge strip (10, 22) and the perforating carrier (9) to restrict the charge strip (10, 22) to rotate and to move axially relatively to the perforating gun body (9), and the positioning mechanism comprises: a positioning ring (18) provided in the perforating carrier (9) with two ends of the ring fixedly connected with the charge strip (10) through a connecting member; a positioning key (19) with one end fixed on the positioning ring (18) and the other end in a positioning slot (8') in the perforating carrier (9); and a limiting screw cover (20) mounted outside the positioning ring (18).

13. The high energy combined perforating device for oil-gas wells as claimed in claim 12, characterized in that said positioning ring (18) is provided with a positioning ring positioning hole (6') radially on a side wall of the positioning ring (18), and the connecting member is inserted into the positioning hole (6') and a charge strip positioning hole (4') on the end of the charge strip (10), and the circular end surface of the positioning ring (18) is provided with a positioning slot (7') for receiving the positioning key (19).

14. The high energy combined perforating device for oil-gas wells as claimed in claim 1, characterized in that said charge strip (22) is machined radially to provide a tail hole (12') and a unit perforator window (9') at common axial length, the unit perforator window (9¢) has a shape of a rectangle with its center line to coincide with a center line of the tail hole (12') at the same axial length, a neighboring tail hole (12') and unit perforator window (9') of different axial lengths and different phases are arranged alternatively according to a common same spiral direction, the positions of the tail hole (12') of different axial lengths and different phases are in one-to-one correspondence with pressure-relief vents (1') of the perforating carrier (9), the positions of a unit perforator window (9') are in one-to-one correspondence with scallops (2') on the perforating carrier (9), and on both sides along the axial direction of the unit perforator windows (9') there are formed respectively a locking slot (10') while there is provided with a charge positioning hole (14') on each side wall of the two ends of the charge strip (22).

15. The high energy composite perforating device for oil-gas wells as claimed in claim 14, characterized in that said unit perforator is mounted in the unit perforator window (9') of the charge strip (22) and comprises a variable diameter charge socket (13') positioned in an axially middle place of an explosive box (23) and formed radially; each of two locking sheets (24) provided at an axial end and outside of the explosive box (23) and being able to lock the explosive box (23) in the unit perforator window (9'); a detonating cord slot (11') formed on an outer cylindrical surface of the explosive box (23), a shaped charge (13) installed in the charge socket (13') of the explosive box (23), the space in the explosive box (23) being provided with the energetic material (25), and the detonating cord (15) being positioned in the detonating cord slot (11') and connected with the gun bottom of the shaped charges (13).

16. The high energy combined perforating device for oil-gas wells as claimed in claim 14, characterized in that the gun bottom (7) is provided with a pressure-relief slot (30).

17. The high energy combined perforating device for oil-gas wells as claimed in claim 14, characterized in that said perforating gun body (9) is 1 meter long and has 5~20 unit perforators in the charge strip (10).

* * * * *